United States Patent [19]

Freyer et al.

[11] Patent Number: 5,069,488

[45] Date of Patent: Dec. 3, 1991

[54] METHOD AND A DEVICE FOR MOVEMENT-COMPENSATION IN RISER PIPES

[75] Inventors: Jan Freyer, Hafrsfjord; Arnfinn Nergaard, Hinna, both of Norway

[73] Assignee: Smedvig IPR A/S, Stavanger, Norway

[21] Appl. No.: 536,668

[22] PCT Filed: Nov. 8, 1989

[86] PCT No.: PCT/NO89/00116

§ 371 Date: Jul. 3, 1990

§ 102(e) Date: Jul. 3, 1990

[87] PCT Pub. No.: WO90/05236

PCT Pub. Date: May 17, 1990

[30] Foreign Application Priority Data

Nov. 9, 1988 [NO] Norway ..... 88 5006

[51] Int. Cl.[5] ..... F16L 27/12

[52] U.S. Cl. ..... 285/302; 285/900; 166/355

[58] Field of Search ..... 285/302, 900; 405/195; 166/355; 175/5, 7

[56] References Cited

U.S. PATENT DOCUMENTS

| | | | |
|---|---|---|---|
| 327,281 | 9/1885 | Letzkus | 285/302 X |
| 853,964 | 5/1907 | Doolittle | 285/302 |
| 2,402,157 | 6/1946 | Griswold | 285/302 X |
| 3,158,206 | 11/1964 | Kammerer . | |
| 3,319,981 | 5/1967 | Burgess | 166/355 X |
| 3,353,851 | 11/1967 | Vincent | 166/355 X |
| 3,643,751 | 2/1972 | Crickmer | 166/355 X |
| 3,721,293 | 3/1973 | Ahlstone et al. . | |
| 4,367,981 | 1/1983 | Shopiro | 166/355 X |
| 4,615,542 | 10/1986 | Ideno et al. | 285/302 X |

FOREIGN PATENT DOCUMENTS

| | | | |
|---|---|---|---|
| 2455645 | 6/1975 | Fed. Rep. of Germany | 285/302 |

*Primary Examiner*—Dave W. Arola

*Attorney, Agent, or Firm*—Wegner, Cantor, Mueller & Player

[57] ABSTRACT

A method for movement-compensating a riser pipe (6) running between a mobile offshore structure (7, 8) and a wellhead (2) on the sea-bed (1), employs a sliding joint (13, 15) in the form of a telescopic device (9) which is volume and pressure balanced. This balancing makes it possible to use the sliding joint under the extreme conditions of pressure which may be experienced in production riser pipes, which the advantage that the production systems may be fitted fixedly to the mobile offshore structure. The method also combines the sliding joint (13, 15) with a hydraulic cylinder (27) which maintains a movement-compensated tension in the riser pipe (6). Several examples of slidng joints (13, 15) with movement-compensated tension cylinders (27, 38, 43) are shown.

12 Claims, 5 Drawing Sheets

METHOD AND A DEVICE FOR MOVEMENT-COMPENSATION IN RISER PIPES

The present invention relates to a method for compensating the movements of a riser pipe running between a mobile offshore structure and a wellhead on the sea-bed, in which the riser pipe is connected fixedly to the offshore structure and at its upper end equipped with a sliding joint and a movement-compensated suspension assembly comprising at least one hydraulic cylinder for that section of the riser pipe which is below the sliding joint.

Such compensation for movement, employing a sliding joint, is common when oil and gas wells are being drilled from a mobile rig, for instance a semi-submersible rig or a drilling vessel. The sliding joint will here compensate for the varying distance between the wellhead and the drilling rig which is caused by tides, the heaving movements of the rig because of waves, and the drift of the rig. During drilling, the pressure inside the riser pipe is comparatively low. However the pressure may increase if a shallow pocket of gas is encountered, and the sliding joint is therefore generally designed to withstand a pressure in the order of magnitude of 35 bar during a shorter period of time. However, in such blowouts of shallow gas it has been found that the sliding joint will start to leak heavily after a short time, probably because the comparatively simple seals of the sliding joint have given small leaks which have rapidly become very much larger due to the flow of gas containing large amounts of highly abrasive impurities. Serious fires have started because of such leaks.

Another problem of previously known sliding joints is that only with difficulty can they be protected from being overloaded. If in an emergency the riser pipe is shut off at both ends while full of incompressible drilling mud, the riser pipe could most aptly be considered as an axially rigid pipe, and any heaving movements that the rig may make, would thus create a very much higher pressure in excess of what the sliding joint can tolerate.

Sliding joints based on the telescoping principle are subjected to axial forces which will seek to urge the various parts of the sliding joint apart and are commensurate with the pressure inside the riser pipe. These forces are absorbed by tension cables attached to the lower section of the sliding joint or the riser pipe directly below it, and these tension cables also serve the purpose of maintaining the tension in that part of the riser pipe which is below the sliding joint. It will be appreciated that if the pressure inside a riser pipe of an internal diameter of 540 mm load on the tension cables and the appurtenant system for movement compensation, necessitating over-dimensioning with the ensuing additional weight and costs.

Production platforms have traditionally been permanent ones, either of the jacket type or concrete gravitation platforms. These have, however, become too costly as the exploitation of oil has moved out to ever increasing depths, and instead mobile rigs such as e.g. tension rod platforms, have been employed. On marginal fields where a permanent platform would also prove too costly, drilling vessels have been used, and chain line anchored semi-submersible drilling rigs converted to production purposes.

Because the pressure inside a production riser pipe may easily be ten times higher than in a drilling riser pipe, this would have resulted in expansion forces in a possible normal sliding joint which would be difficult to handle without the costs becoming prohibitive. Production riser pipes for mobile production platforms where there has been a requirement for vertical accessability in the well, have therefore been constructed as an integrated unit suspended in tension systems and guides, capable of absorbing the necessary strokes and angular deviations. Such rigid riser pipes present the drawback that all operations must be based on moving systems (production trees, blow-out preventer valves etc.) with correspondingly complicated connections. Furthermore, a complicated, voluminous and expensive tension suspension system is required.

In order to avoid some of these problems, flexible riser pipes have been used, suspended freely in the water, but these have not afforded vertical well accessibility and, besides, they have been very expensive both to purchase, install and maintain.

The aim of the present invention is to provide a method for compensating the movements of riser pipes which is not encumbered by the above mentioned shortcomings and drawbacks.

This is achieved according to the invention by a method of the type mentioned initially where the characteristic feature is that the sliding joint used is a telescoping device which is volume and pressure balanced. Volume balanced shall be deemed to mean that the telescoping device may be extended and compressed without any net conveyance of fluid taking place into or out of it. Pressure balanced shall be deemed to mean that there will be no effect of axial forces seeking to urge the parts of the telescoping device apart, regardless of the internal pressure.

The pressure balancing causes the sliding joint to be capable of tolerating very high internal pressures without axial forces being created which will need to be absorbed by the usual tension suspension system. Consequently, it will only be necessary to dimension for the tension which must be maintained in the riser pipe below the sliding joint, with ensuing major savings.

The volume balancing permits axial movements in the sliding joint even if the riser pipe should happen to be shut at both ends in an emergency. The platform will thus be able to make maximal heaving movements in such a situation without experiencing fluctuations of pressure nor any other resistance to the telescoping of the sliding joint.

Further advantages of the method according to the invention are the fact that by using one single unit, with a minimum of auxiliary systems, operations are possible as on a permanent platform. Production trees, blow-out preventers etc. may be placed permanently on deck Any complications generally existing on a mobile rig, will be avoided by using a special sliding joint situated below the working decks, which may furthermore be rendered easily replaceable. By means of the invention it is possible to combine low-price platforms with low-price well systems and thus achieve savings which by far exceed the costs of the sliding joint itself.

According to an advantageous embodiment of the method, the sliding joint used is a telescoping device which comprises a telescope casing with an internal cylinder surface, a telescopic pipe which has an external cylinder surface and is sealedly and slidingly arranged in the telescope casing, an annular piston on the outside of the telescopic pipe in contact with the internal cylinder surface of the telescope casing, so that a chamber is formed on either side of the piston, one of which communicates with the inside of the telescope casing, and the other one communicates with a source of fluid of substantially constant pressure, the cross section area of the internal cylinder surface of the telescope casing being twice that of the cross section area of the external cylinder surface of the telescopic pipe.

A similar telescopic device is more or less known from U.S. Pat. No. 2,373,280, issued on 10 Apr. 1945. This previously known device was developed as a pressure balanced thermal expansion joint for pipes in plants for the manufacture of synthetic rubber where temperatures could become very high. The patent is silent on volume balancing, and it is possible that the inventor has not been aware of this characteristic of the expansion joint, since it was not required for his purpose. In any circumstances, nobody appears to have realized previously that a similar telescoping joint could advantageously be used in riser pipes for the production of oil and gas from mobile platforms.

According to a further embodiment of the invention, it is suggested that the hydraulic cylinder of the suspension assembly be incorporated into the telescoping device. This may for instance be done by arranging the hydraulic cylinder as an annular casing round a cylindrical surface on the outside of the telescoping device, which is provided with an annular collar to form the piston of the hydraulic cylinder, the annular casing being connected, directly or indirectly, to the offshore installation.

In this way the usual tension cables are obviated, with their comparatively complicated tension cylinders and an uncomplicated, compact, robust and dependable unit is obtained which handles both the movement compensation and the tension function.

If it is desirable to prevent the well product from contact with the seals of the sliding joint, e.g to prevent abrasive particles in the well product from damaging the seals, it is suggested according to the invention to provide the connection between the said one chamber and the inside of the telescopic pipe by way of a pressure vessel with a movable partition, preferably a cylinder with a floating piston.

The invention also relates to a telescoping device as defined in patent claims 6 to 10.

To further illustrate the invention, it will be described in greater detail with reference to the working examples shown in the attached drawings.

Figure 1:
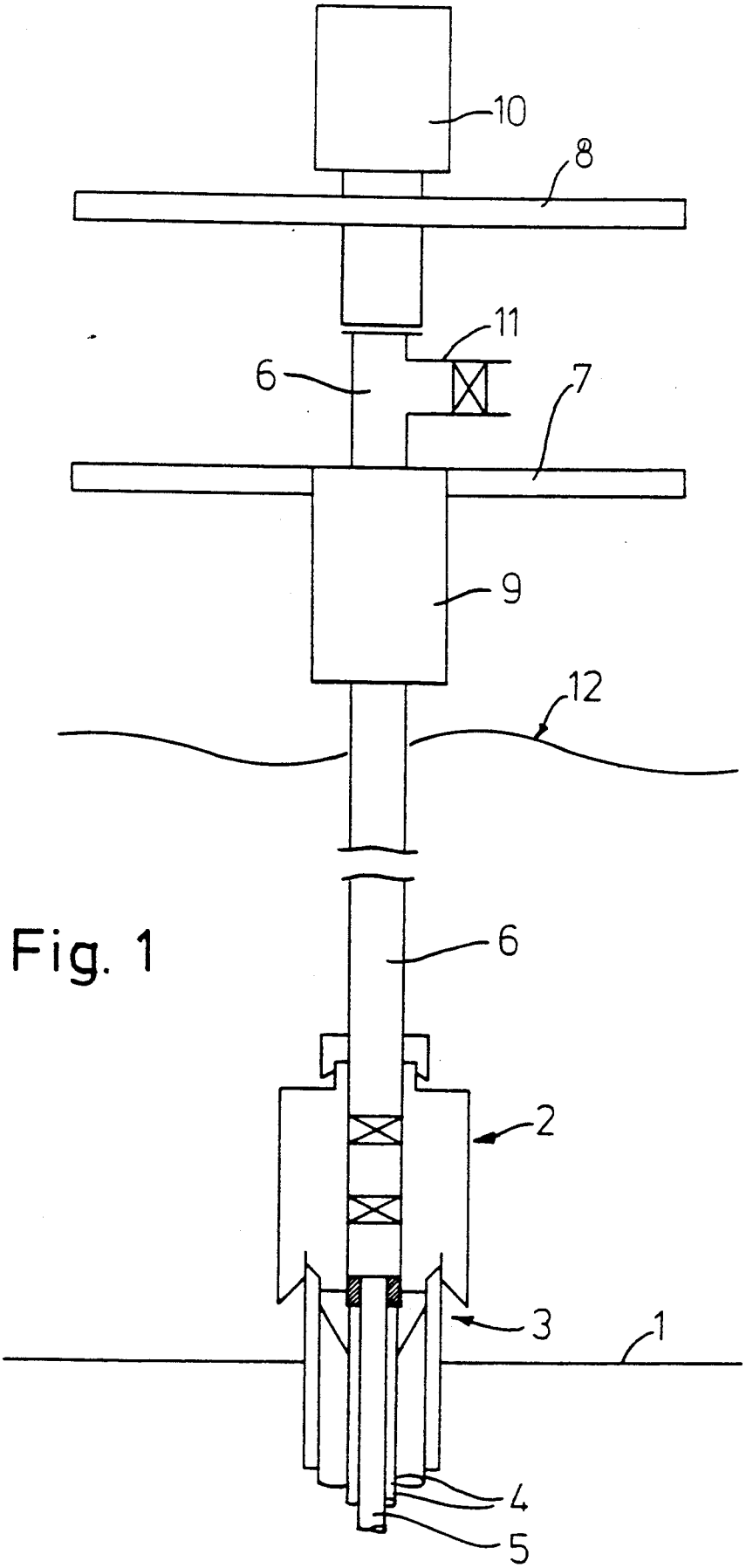
FIG. 1 shows a schematic outline, partly in section, of an offshore well installation and a riser pipe which is equipped with a device according to the invention and which leads from the well installation to the mobile platform above.

Reference will be made first to FIG. 1 which among other things shows a wellhead on the sea-bed 1. The wellhead comprises a valve tree 2, a pipe suspension assembly 3 and bushing pipes 4 of various diameters extending into the ground. This also applies to a production pipe 5.

From the wellhead a riser pise 6 extends upwards to a mobile rig structure, only indicated with its production deck 7 and BOP-deck 8. The riser pipe 6 is connected to a telescopic device 9 according to the invention which is attached underneath the production deck 7 of the platform. From the telescopic device the riser pipe continues upwards to a BOP 10, and between this and the telescopic device, a production pipe 11 branches off.

Cyclical changes in the distance between the sea-bed 1 and the platform 7, 8, for instance due to tides and waves on the surface of the sea 12, will be absorbed as axial shifting of the riser pipe 6 in the telescopic device 9. If the riser pipe is subjected to major bending strains, e.g caused by the horizontal drift of the platform, it may become necessary to provide the riser pipe with flexible high pressure joints. Such flexible joints will, however, be well known to someone skilled in the art, and consequently require no further explanation here.

Figure 2:
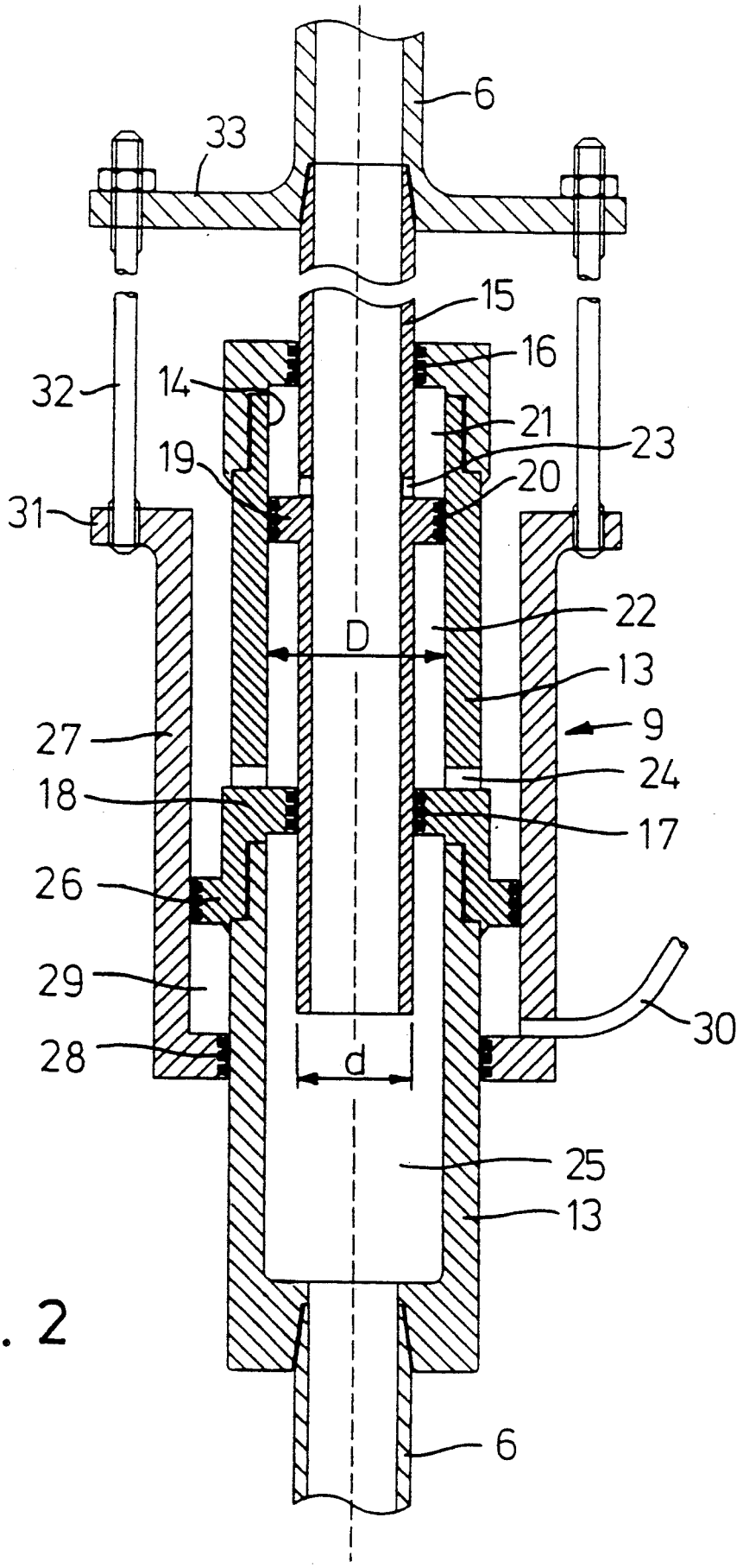
FIG. 2 shows an axial section through a telescopic device according to the invention.

The construction of the telescopic device 9 is further illustrated in FIG. 2. The telescopic device comprises a telescope casing 13, which has an internal sylinder surface 14 of diameter D. A telescopic pipe 15 of external diameter d, where $d=D\sqrt{2}$, is slidingly received into the telescope casing 13. A sealing area 16 provides a seal between the telescopic pipe 15 and the upper end of the telescope casing 13, while a second sealing area 17 provides a seal against the telescopic pipe at an internal collar 18 inside the telescope casing. Between the sealing areas 16 and 17, the telescopic pipe 15 is provided with an annular piston 19 which, by means of a sealing area 20, provides a seal against the internal cylinder surface 14 of the telescope casing 13. Thus, an upper annular chamber 21 is created above the piston 19, and a lower annular chamber 22 underneath the piston. The cross section area of these chambers 21, 22 and the piston 19 is, because of the ratio stated above of diameter D to diameter d, equal to the external cross section area of the telescopic pipe 15.

The upper chamber 21 communicates with the inside of the telescopic pipe 15 through ports 23 in the telescopic pipe. The lower chamber 22 communicates with the ambient atmosphere via ports 24 in the telescope casing 13. Thus, the same pressure will prevail in the chamber 21 as in the telescopic pipe 15 and the lower part of the telescope casing 13. Because the area of the piston 19 equals the cross section area of the telescopis pipe 15, the force with which the pressure in the lower part 25 of the telescope casing seeks to expel the telescopic pipe 15, will be precisely balanced by the force acting in the opposite direction against the piston 19. The gliding joint formed by the telescope casing 13 and the telescopic pipe 15, is thus completely pressure balanced.

If one envisages that the telescopic pipe 15 is being pushed into the telescope casing 13, the telescopic pipe will displace fluid from the lower part 25 of the telescope casing. However, the volume of the upper chamber 21 will increase to exactly the same degree so that any fluid displaced from the lower chamber 25 will flow through the ports 23 and into the upper chamber 21. There is consequently no net conveyance of fluid into or out of the telescopic device 9 from relative movements between the telescopic pipe and the telescope casing, and the sliding joint formed by them is thus completely volume balanced.

In order to maintain the requisite tension in that part of the riser 6 which is below the telescopic device 9, it will be necessary to employ a suspension assembly which is compensated for movement and exerts a constant lifting force against for instance the telescope casing 13. As mentioned initially, this is usually done by means of a complicated system of tension cables and hydraulic cylinders. These hydraulic cylinders communicate with a sufficiently large source of hydraulic fluid of substantially constant pressure, for instance a battery of accumulators.

According to the invention, a very straightforward way has been found in which to solve the problem of tension. This is done by using a hydraulic cylinder in connection with the telescopic device itself, to exert the required lifting force in the telescope casing.

One example of how this may be done is shown in FIG. 2. The telescope casing 13 is here provided with a piston in the form of an outside flange 26 which provides a gliding seal against a cylinder 27 arranged round the telescope casing. The cylinder 27 is sealed against the telescope casing at 28 below the piston 26, to provide a cylinder chamber 29. This chamber communicates through a conduit 30 with a source of hydraulic fluid at constant pressure, e.g. the usual battery of accumulators.

The cylinder 27 is at its upper end provided with a flange 31 and this in turn is by means of bolts 32 fixedly attached to a flange 33 on the upper part of the riser pipe 6. This in turn is fixedly connected to the production deck of the platform 7, so that the tensile forces are transferred to the deck. Thus, it has been possible here to achieve a replacement of the usual tension cable system, which with its usually four hydraulic cylinders and systems of hoist pulleys requires much space on the production deck, by one single hydraulic cylinder, taking up a minimum of space both because it has been incorporated into the telescopic device and in its entirety is located out of the way underneath the production deck. Because the tension cables are obviated, the solution according to the invention entails the added advantage that friction is reduced, enabling a more constant tension to be maintained in the riser pipe.

Figure 3:
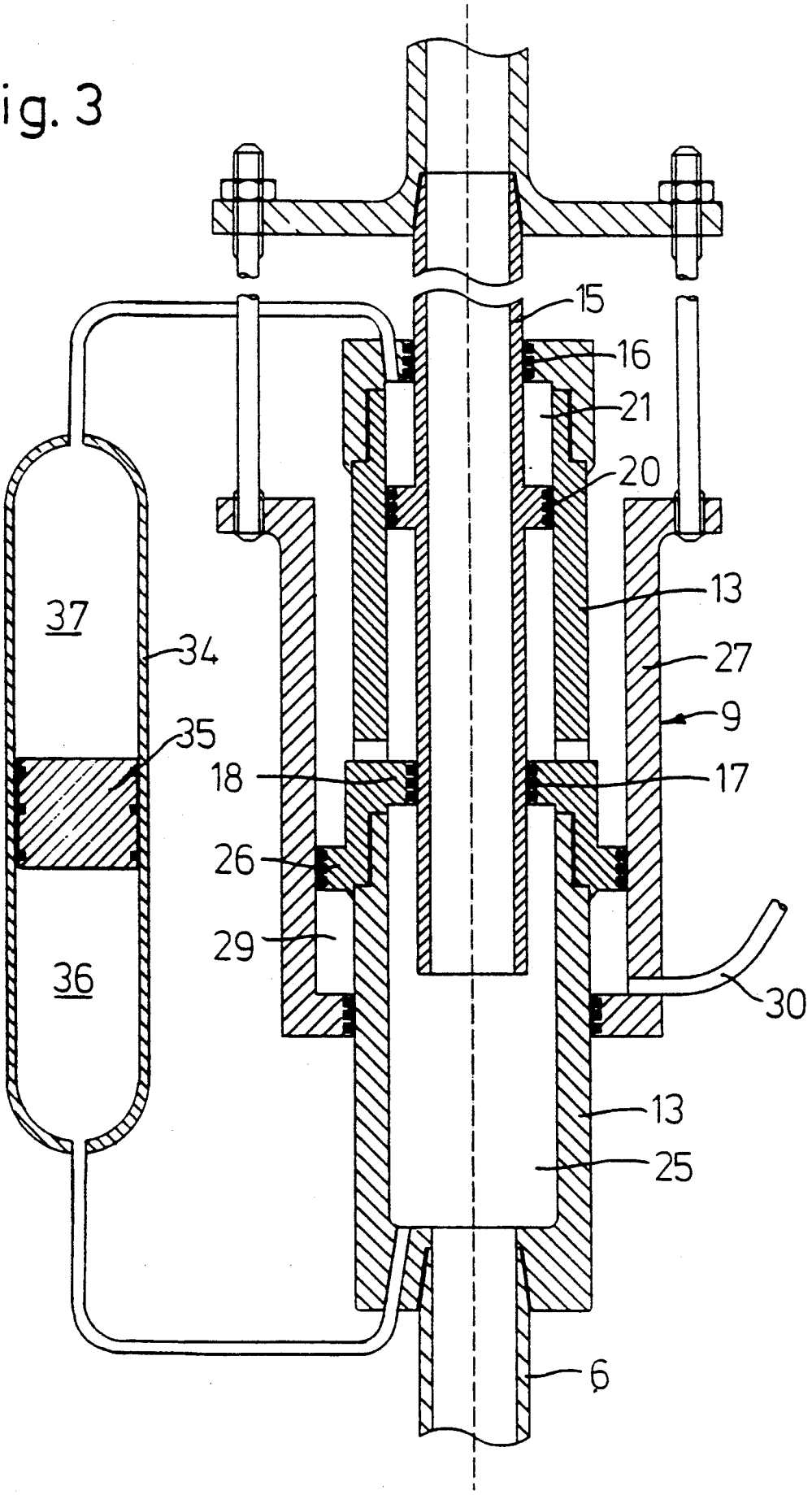
FIG. 3 shows an axial section through a modification of the telescopic device of FIG. 2.

If the well fluid produced contains abrasive impurities which it is desirable to keep away from the seals of the telescopic device, particularly in the annular chamber 21 shown in FIG. 2, it is possible to proceed as indicated in FIG. 3. There are here no ports 23 between the inside of the telescopic pipe 15 and the chamber 21. The communication of pressure between this chamber and the fluid in the riser pipe takes place via a pressure vessel 34 with a floating piston 35, which forms a partition between the contaminated product in the lower part 36 of the pressure vessel and a pure hydraulic fluid in the upper part 37 of the vessel. Thereby it is possible to ensure optimal lubrication and corresponding long life of the sealing areas 16 and 20. The sealing area 17 is somewhat less exposed, because impurities in the well fluid are unable to form a sediment on its upper surface, but in order to give it extra protection, it may be provided with injection of pure oil, for instance taken from the chamber 29 of the tension cylinders through a duct in the piston 26, the body of the telescope casing and the internal collar 18. Optionally this connection may be placed openly between the piston 26 and the collar 18 so that a non-return valve may be positioned here to prevent inadvertent return flow of well fluid to the chamber 29.

Figure 4:
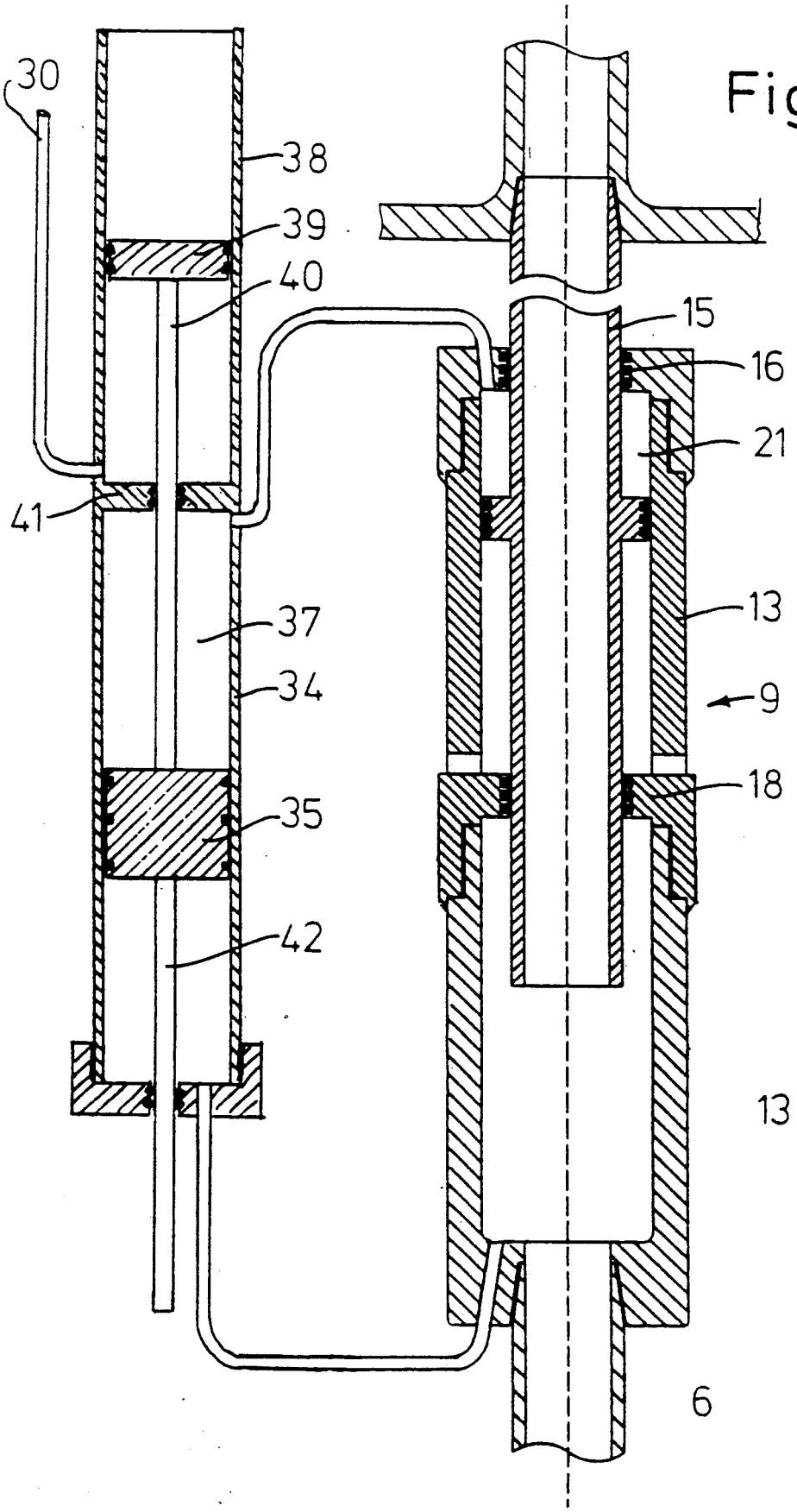
FIG. 4 shows a lengthwise section of a modification of the embodiment of FIG. 3.

FIG. 4 shows a modification of the hydraulic cylinder for maintaining tension in the riser pipe. Here the pressure vessel 34 has been extended by means of an auxiliary cylinder 38 in which is arranged an auxiliary piston 39. The auxiliary piston 39 is connected to the piston 35 of the pressure vessel via a piston rod 40 which is carried sealedly through a fixed partition wall 41 between the pressure vessel 34 and the auxiliary cylinder 38. The conduit 30 from the battery of accumulators communicates with the auxiliary cylinder below the piston 39. A piston 42 is connected to the underside of the piston 35 and carried through the bottom of the pressure vessel 34 in order to provide the same effective area on both sides of the piston 35. The piston rod 42 may be obviated for instance by executing the piston 35 as a differential piston.

It will be seen that in this embodiment, the external cylinder 27 of the telescope casing 13 has been obviated. Instead, the tension in the riser pipe is produced by, in the annular chamber 21, in addition to the internal pressure in the telescope casing 13, superimposing a pressure which is sufficient to provide the required lifting force in the telescope casing 13 relative to the telescopic pipe 15. This superimposed pressure is created in the chamber 37 of the pressure vessel 34 by supplying an appropriate pressure to the auxiliary cylinder 38 through the conduit 30.

Figure 5:
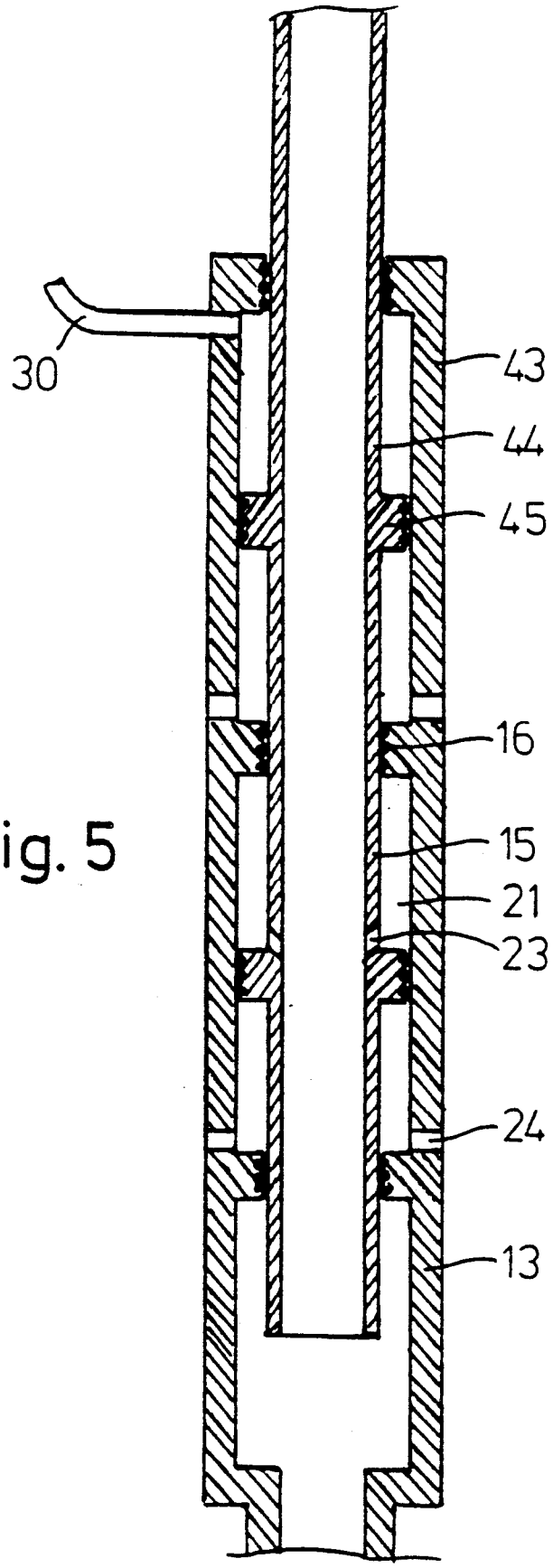
FIG. 5 shows a lengthwise section of one variety of the telescopic device according to the invention.

FIG. 5 illustrates a further example of how the tension cylinder may be combined with- the telescopic device. Used here as the basis is the embodiment of the telescope casing and the telescopic pipe shown in FIG. 2. The external cylinder 27 has been removed and has instead been replaced by a cylinder 43 which constitutes an extension of the telescope casing 13. Then telescopic pipe 15 is provided with a corresponding extension 44, having an annular piston 45 slidingly arranged in the cylinder 43. The cylinder chamber above the piston 45 communicates with the battery of accumulators or the like through the conduit 30.

This embodiment lends greater length to the telescopic device, something which may be a restricting factor if the telescopic device needs to be able to cater for strokes of 7.5 m or more, but provides the advantage in comparison with the embodiment of FIG. 4 that the differential pressure above the sealing area 16 will be lower.

Although the invention has been described above in connection with concrete working examples, it will be appreciated that it is in no way limited to these, but may be modified and varied in a number of ways within its basic concept. As an example of such modifications may be mentioned that the telescopic device may be turned upside-down so that the telescope casing is fitted fixedly to the platform while the telescopic pipe is connected to the lower part of the riser pipe. Furthermore, the pressure vessel 34 of FIG. 3 may be given a number of different embodiments, the piston 35 may for example be replaced by a sufficiently flexible membrane, and it will here be possible to use an ordinary hydraulic accumulator as the pressure vessel. The telescopic device may advantageously be provided with e.g. hydraulically operated attachments at both ends to afford brief installation and dismantling time for maintenance and possible replacement. For the same purpose, the upper part of the lower section of the riser pipe may be provided with a suspension device.

I claim:

1. A method for compensating for movements in a riser pipe running between a mobile offshore structure and a wellhead on a sea-bed, in which the riser pipe is connected fixedly to the offshore structure, comprising the steps of:

providing the riser pipe with a sliding joint proximate an upper end thereof, wherein the sliding joint is a telescopic device which is volume and pressure balanced; and tensioning a part of the riser pipe below the sliding joint with a movement-compensated suspension assembly comprising at least one hydraulic cylinder.

2. A method according to claim 1, wherein the sliding joint is a telescopic device comprising a telescope casing with an internal cylinder surface, a telescopic pipe which has an external cylinder surface and is sealedly and slidingly arranged in the telescope casing, an annular piston on the outside of the telescopic pipe in contact with the internal cylinder surface of the telescope casing so that a chamber is formed on either side of the piston, one of said chambers having pressure communication with the inside of the telescope casing and the other one of said chambers communicating with a source of fluid of substantially constant pressure, the cross sectional area of the internal cylinder surface of the telescope casing being twice that of the cross sectional area of the external cylinder surface of the telescopic pipe.

3. A method according to claim 2, wherein the hydraulic cylinder of the suspension assembly is incorporated into the telescopic device.

4. A method according to claim 3, wherein the hydraulic cylinder is arranged as an annular casing around a cylindrical surface on the outside of the telescopic device which is provided with an annular collar to form the piston of the hydraulic cylinder, the annular casing being connected fixedly to the offshore structure.

5. A method according to claim 2, wherein pressure communication between the said one chamber and the inside of the telescope casing is provided via a pressure vessel with a movable partition comprising a cylinder with a floating piston.

6. A method according to claim 2, wherein said substantially constant pressure is approximately the ambient atmosphere.

7. A telescopic device for absorbing variations in the length of a pipe, comprising a telescope casing with an internal cylinder surface, a telescopic pipe which has an external cylinder surface and is sealedly and slidingly arranged in the telescope casing, an annular piston on the outside of the telescopic pipe in contact with the internal cylinder surface of the telescope casing so that a chamber is formed on either side of the piston, one of which has pressure communication with the inside of the telescope casing and the other of which communicates with a source of fluid at substantially constant pressure, the cross sectional area of the internal cylinder surface of the telescope casing being twice the cross sectional area of the external cylinder surface of the telescopic pipe, wherein the telescopic device is adapted to function as a sliding joint in a riser pipe between a mobile offshore structure and a petroleum well on a sea-bed, and wherein a hydraulic cylinder for providing movement-compensated tension loading of a part of the riser pipe which is below the telescopic device is combined with the telescopic device.

8. A telescopic device according to claim 7, wherein said telescopic device comprises a pressure vessel with a movable partition which is arranged in the pressure communication between said one chamber and the inside of the telescope casing.

9. A telescopic device according to claim 8, wherein the hydraulic cylinder is combined with the pressure vessel, the hydraulic cylinder having a piston rod which is connected to the partition of the pressure vessel, the partition having the form of a piston.

10. A telescopic device according to claim 7, wherein the hydraulic cylinder comprises an annular casing arranged around a cylindrical surface on the outside of the telescope casing which has an annular collar which forms a piston of the hydraulic cylinder, and wherein the annular casing is fixedly connectable to the offshore structure.

11. A telescopic device according to claim 7, wherein the hydraulic cylinder is incorporated into the sliding joint with extensions of the telescope casing and the telescopic pipe.

12. A telescopic device according to claim 6, wherein said substantially constant pressure is approximately the ambient atmosphere.

* * * * *